US008651300B2

(12) United States Patent
Chen

(10) Patent No.: US 8,651,300 B2
(45) Date of Patent: Feb. 18, 2014

(54) SECTIONAL RACK

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 59 days.

(21) Appl. No.: 13/305,257

(22) Filed: Nov. 28, 2011

(65) Prior Publication Data

US 2012/0298607 A1 Nov. 29, 2012

Related U.S. Application Data

(63) Continuation-in-part of application No. 13/116,302, filed on May 26, 2011, now abandoned.

(51) Int. Cl.
*A47B 43/00* (2006.01)

(52) U.S. Cl.
USPC ..... 211/187; 211/182; 108/107; 108/111

(58) Field of Classification Search
USPC ..... 211/187, 186, 181.1, 182; 108/107, 111
See application file for complete search history.

(56) References Cited

U.S. PATENT DOCUMENTS 2,894,643 A * 7/1959 Maslow ..... 211/189
2,970,702 A * 2/1961 Maslow et al. ..... 108/106
3,208,406 A * 9/1965 Maslow ..... 108/64
4,079,678 A * 3/1978 Champagne ..... 108/110
4,582,001 A * 4/1986 Leikarts ..... 108/106
4,750,626 A * 6/1988 Nicely ..... 211/187
5,065,873 A * 11/1991 Tseng ..... 211/187
5,833,084 A * 11/1998 Chang ..... 211/187
7,513,471 B2 * 4/2009 Moufflet ..... 248/218.4
7,568,436 B2 * 8/2009 McAllister et al. ..... 108/147.12
7,992,731 B2 * 8/2011 Mcallister et al. ..... 211/187

* cited by examiner

*Primary Examiner* — Korie H Chan
(74) *Attorney, Agent, or Firm* — WPAT, PC; Justin King

(57) ABSTRACT

A sectional rack includes at least four vertical supports, at least two shelves, and a plurality of clamping members. Each vertical support includes two laterally juxtaposed left and right posts, and a plurality of connecting members connected to between the two posts. Each clamping member defines a vertically extended receiving recess, which has two wing portions formed at two ends of an open side thereof, and is sized for one post of the vertical support to partially set therein, allowing the clamping member to assemble to the vertical support. The shelves are respectively provided at four corners with an outward-opened C-shaped clamping member each for tightly fitting around and thereby pushing the two wing portions of the clamping member toward each other to firmly clamp the post in the receiving recess, so that the four corners of the shelves are firmly connected to the posts of the four vertical supports.

6 Claims, 9 Drawing Sheets

SECTIONAL RACK

CROSS REFERENCE TO RELATED DOCUMENT

This application is a continuation-in-part of U.S. patent application Ser. No. 13/116,302 filed on May 26, 2011.

FIELD OF THE INVENTION

The present invention relates to a sectional rack, and more particularly to a sectional rack, of which shelves are tightly connected to four vertical supports through tight fitting of C-shaped clamping members provided at four corners of the shelves around clamping members assembled to the vertical supports, giving the sectional rack an increased structural strength.

BACKGROUND OF THE INVENTION

Various types of organizers are provided in homes, offices or other working places for holding or positioning different articles and items. Such organizers can be generally divided into a fixed type that could not be easily disassembled and a sectional type that can be easily disassembled and assembled again. The sectional organizers have the advantages of easy to store and transport to thereby enable reduced storing and transporting costs and accordingly upgraded market competing ability.

The sectional organizers can be further divided into two types, one of which requires tools to assemble and disassemble it while the other type can be assembled and disassembled without the need of using any tool. Among the same type of sectional organizers, products that can be assembled using fewer tools would be accepted by more consumers. For example, U.S. Pat. Nos. 5,676,263; 5,303,645; 5,174,676; 4,991,725; 4,799,818; 4,595,107; 4,546,887 and 4,763,799 all disclose structures in connection with sectional racks using bamboo-like vertical posts. The bamboo-like posts are respectively provided with a plurality of vertically spaced annular grooves, to each of which a substantially conic clamping member can be connected and held in place. Then, a shelf can be firmly assembled to between the posts by tightly fitting conic sleeves provided at four corners of the shelf around the conic clamping members on the bamboo-like vertical posts. However, with the above rack structure, the shelves could not be assembled to two opposite sides of the vertical posts at the same height, giving the whole rack a disorder appearance.

A currently commercially available sectional rack with vertical supports has a left and a right vertical support, and a plurality of shelves assembled to and between the two vertical supports. Each of the two vertical supports includes a front twin-post support having two juxtaposed front posts and a rear twin-post support having two juxtaposed rear posts, and at least two vertically spaced connecting members. The connecting members are welded at front and rear ends to the front and the rear twin-post support, respectively. Therefore, the shelves can be assembled to two opposite sides of the twin-post vertical supports at the same height.

Every shelf is fixedly provided at four corners with a fastening connector each. The fastening connectors are respectively an axially extended U-shaped bracket to define a U-shaped receiving space therein. The U-shaped receiving spaces of the fastening connectors located at two front corners of the shelves are forward opened, while the U-shaped receiving spaces of the fastening connectors located at two rear corners of the shelves are rearward opened. The receiving spaces of the fastening connectors at four corners of the shelves can be engaged with corresponding front and rear twin-post supports of the two side support frames, so that the front and rear fastening connectors at two lateral sides of the shelves outward push against the front twin-post supports and the rear twin-post supports of the two side support frames and are fixedly assembled to between the two side support frames. The above-structured sectional rack has relatively low structural strength and tends to wobble sidewardly. To overcome this problem, it is necessary to erect two crossed tension braces between the rear twin-post supports of the two side support frames to give the assembled sectional rack an increased structural strength. Since the crossed tension braces are not suitable for mounting to between the front twin-post supports of the two side support frames, the sectional rack could not have balanced front and rear structural strength. Thus, the whole sectional rack still has poor structural strength and tends to wobble sidewardly when an external force is applied thereto.

SUMMARY OF THE INVENTION

A primary object of the present invention is to provide a sectional rack including at least two shelves and four vertical supports, which can be firmly connected to one another to give the fully assembled sectional rack an increased overall structural strength.

Another object of the present invention is to provide a sectional rack that can be sidewardly extended to have an increased overall width and allows the shelves assembled to two opposite sides of the vertical supports to locate at the same height, enabling the fully assembled rack to have a harmonious and aesthetic appearance.

To achieve the above and other objects, the sectional rack according to the present invention includes at least four vertical supports, at least two shelves, and a plurality of clamping members. Each of the vertical supports includes two laterally juxtaposed posts, namely, a left and a right post, as well as multiple connecting members for connecting the left and the right post to each other. Each of the clamping members defines a vertically extended receiving recess and has two wing portions laterally extended from two opposite lateral edges of an open side of the receiving recess. The receiving recess is sized for one post of the vertical support to partially set therein, allowing the clamping member to assemble to the vertical support. Each of the shelves is provided at each of four corners with an outward-opened C-shaped clamping member for tightly fitting around and thereby pushing the two wing portions of one clamping member toward each other for firmly clamping the post in the receiving recess, so that the four corners of the shelf are separately firmly connected to the four vertical supports.

In the sectional rack of the present invention, each of the wing portions has a width that is increased from an upper end to a lower end of the wing portion, such that a laterally outer end surface of the wing portion is a gradually downward outward inclined surface; and the wing portion has an outside surface that is also a gradually downward outward inclined surface. Each of the C-shaped clamping members has two ends forming a pair of retaining portions facing toward each other, such that a space left between the two retaining portions defines an opening of the C-shaped clamping member. Two opposite inner end surfaces of an inner space enclosed in the C-shaped clamping member are inclined surfaces, so that a width of the inner space of the C-shaped clamping member measured between the two opposite inner end surfaces gradually increases from top to bottom; and an inside surface of each of the two retaining portions facing toward the inner space of the C-shaped clamping member is an inclined surface having a gradient the same as that of the inclined outside surface of the wing portion. With the inclined surfaces on the C-shaped clamping member correspondingly and fitly bearing on the inclined surfaces on the wing portions of the clamping member, the C-shaped clamping member is able to produce a tightening effect on the two wing portions and pushes them toward each other, so that the clamping member can more tightly clamp the post in the receiving recess.

In an embodiment of the sectional rack of the present invention, the left and right posts of the vertical supports are pipes respectively having an oblong cross section with two opposite round ends and a straight middle body.

In another embodiment of the sectional rack of the present invention, the left and right posts of the vertical supports are pipes respectively having an elliptic or a circular cross section.

In the sectional rack of the present invention, the connecting members of the vertical supports are provided in pairs. The pairs of connecting members are vertically equally spaced between the left and the right post to connect the two posts to each other. A distance between the two connecting members in the same one pair is larger than and very close to a height of the clamping member, so that the clamping member can be located between the two connecting members.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
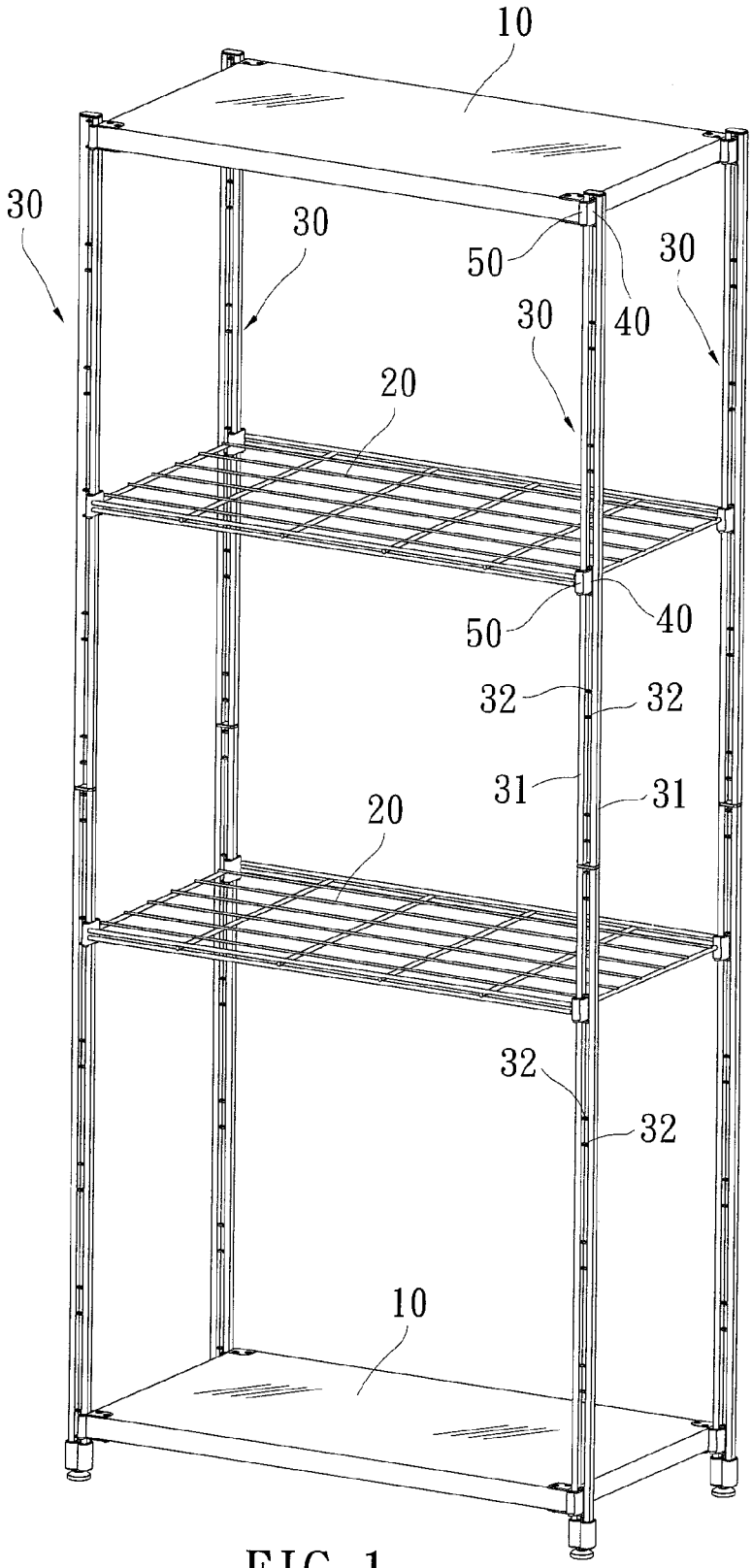
FIG. 1 is an assembled perspective view of a sectional rack according to an embodiment of the present invention.

Please refer to FIG. 1 that is an assembled perspective view of a sectional rack according to an embodiment of the present invention. The sectional rack of the present invention includes at least four vertical supports 30, at least two shelves 10, 20, and a plurality of clamping members 40. In the illustrated embodiment, there are included four vertical supports 30, two shelves 10 that are respectively in the form of a plate, and two shelves 20 that are wire shelves. As shown in FIG. 1, the shelves 10, 20 are respectively connected at four corners to the four vertical supports 30 to provide an assembled sectional rack of the present invention.

Figure 2:
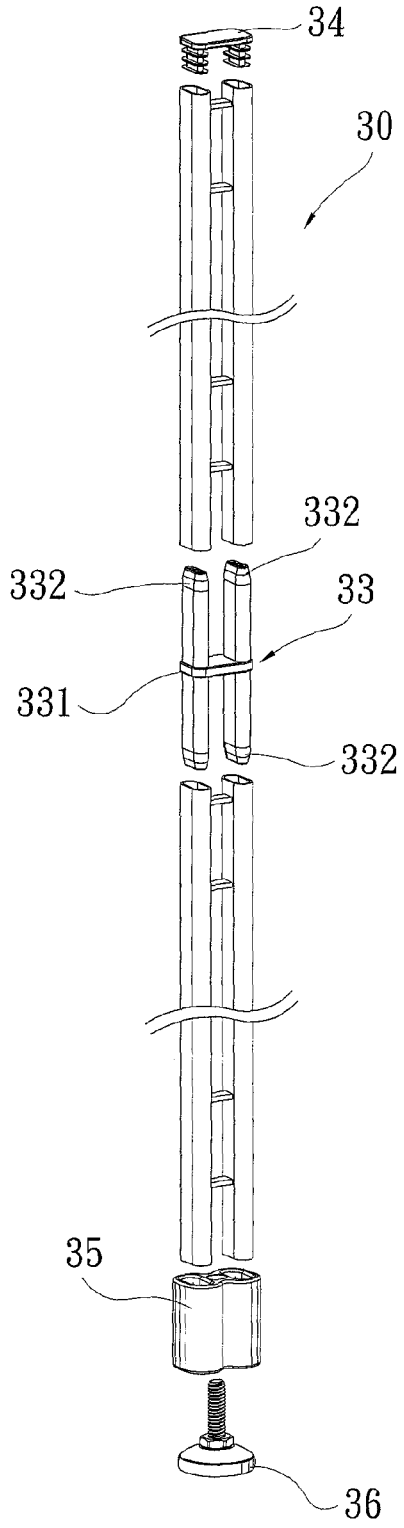
FIG. 2 is an exploded perspective view of a vertical support for the sectional rack of the present invention.

Please refer to FIG. 2. The vertical supports 30 respectively include two laterally juxtaposed posts 31, namely, a left and a right post; and a plurality of vertically equally spaced connecting members 32. The connecting members 32 are provided between the two laterally juxtaposed posts 31 of each of the vertical supports 30 to connect the left and right posts 31 into an integral unit. The connecting members 32 are fixedly connected to the left and right posts 31, such that a space between the left and the right post 31 is defined by a width of the connecting members 32. The two posts 31 of the vertical support 30 may respectively have an oblong cross section with two opposite round ends and a straight middle body. Two shorter vertical supports may be vertically connected end to end via a union 33 to form an integral vertical support. The union 33 is an H-shaped member including a stop plate 331 and four insertion pins 332 axially connected to two outer ends of an upper and of a lower surface of the stop plate 331. The four insertion pins 332 may be correspondingly inserted into the four posts 31 of the two vertical supports 30 located above and below the stop plate 331 of the union 33 to thereby connect the upper and the lower vertical support into one integral body. Plugs 34, 35 may be used to seal open top and open bottom of the vertical support 30, respectively. The plug 35 for sealing the open bottom of the vertical support 30 may be further provided at a lower end with a leg 36.

Figure 3:
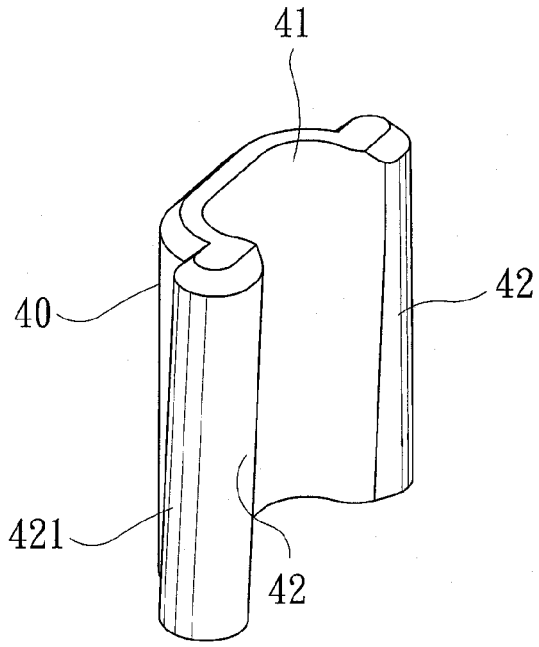
FIG. 3 is a perspective view of a clamping member according to the present invention, viewed from an inside thereof.
Figure 4:
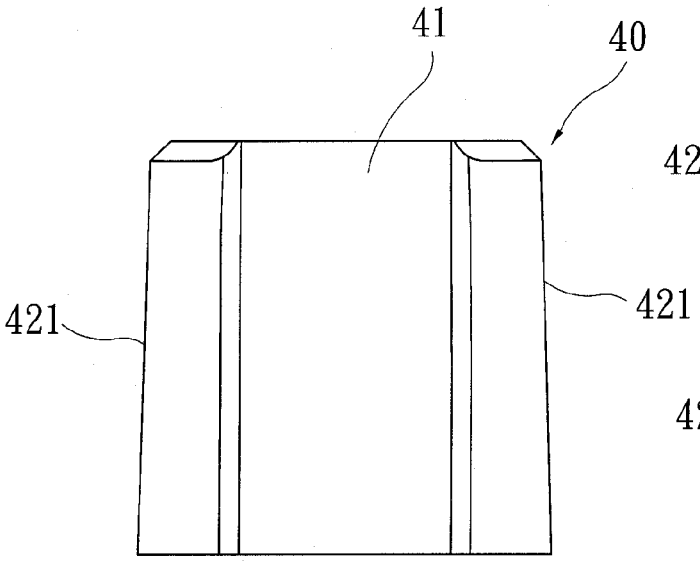
FIG. 4 is an elevational view of the clamping member of FIG. 3, viewed from the inside thereof.
Figure 5:
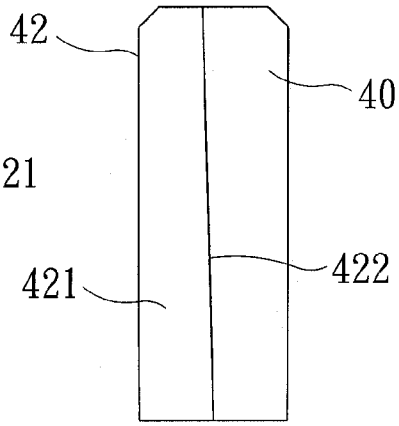
FIG. 5 is a side view of the clamping member of FIG. 3.
Figure 6:
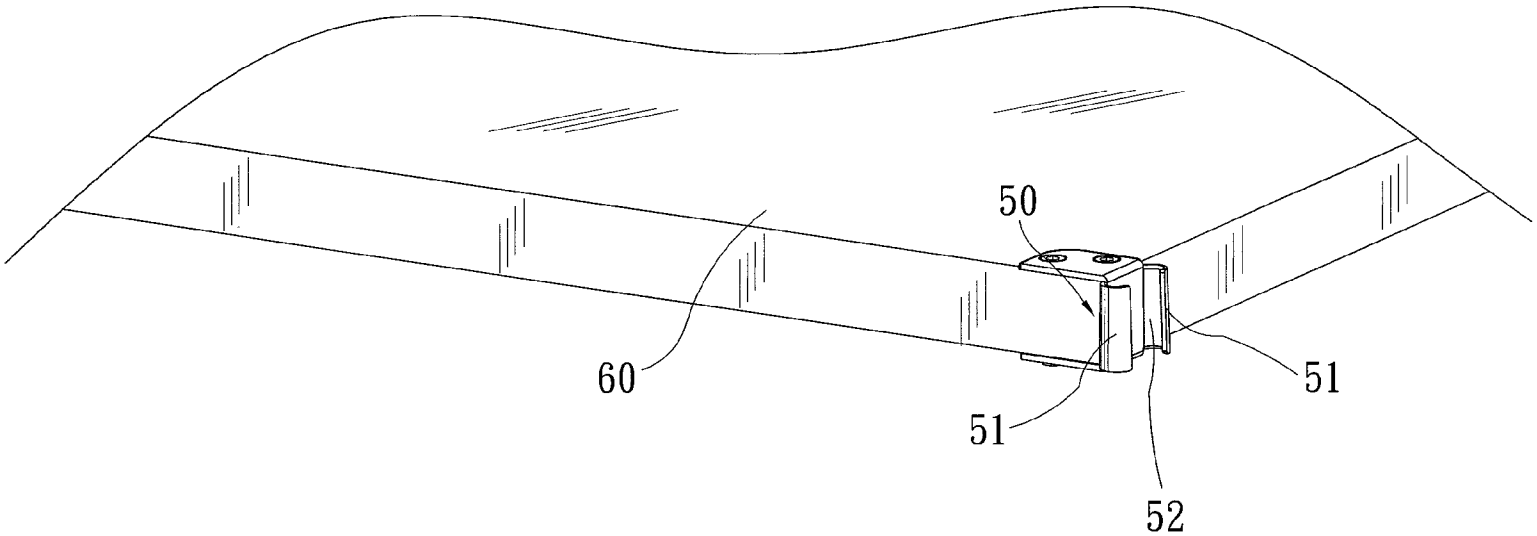
FIG. 6 is a fragmentary perspective view of a shelf according to the present invention, showing a C-shaped clamping member provided on a corner thereof.
Figure 7:
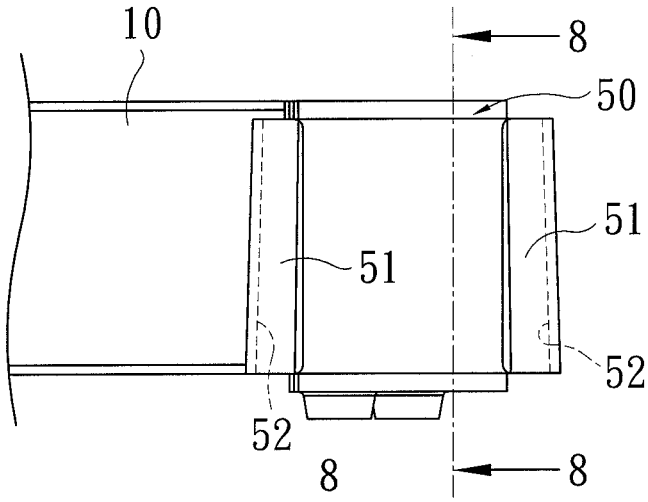
FIG. 7 is a fragmentary side view of the shelf of FIG. 6.
Figure 8:
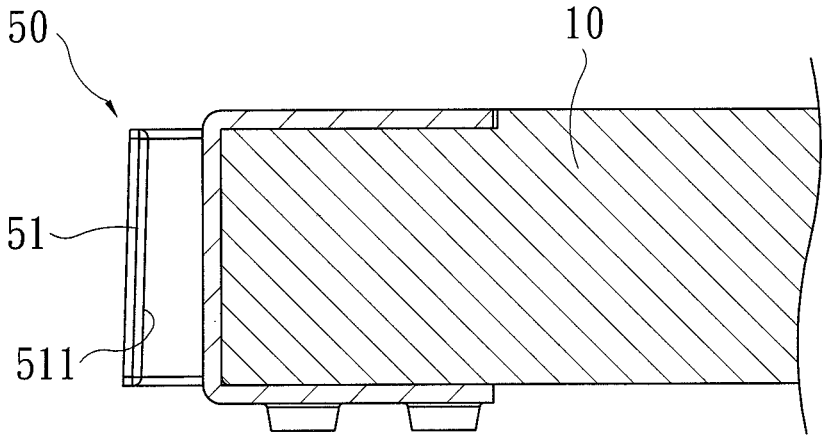
FIG. 8 is a sectional view taken along line 8-8 of FIG. 7.

Please refer to FIGS. 3, 4 and 5. Each of the clamping members 40 defines at an inside with a vertically extended receiving recess 41, and has two wing portions 42 separately laterally extended from two opposite lateral edges of an open side of the receiving recess 41. The receiving recess 41 is sized for one of the two juxtaposed posts 31 of each vertical support 30 to partially set therein, allowing the clamping member 40 to assemble to the vertical support 30 with the open side of the receiving recess 41 facing toward the shelf 10 or 20 connected to between the four vertical supports 30, as can be seen from FIGS. 9 and 10. Each of the two wing portions 42 has a width that is increased from an upper end to a lower end of the wing portion 42, such that a laterally outer end surface 421 of the wing portion 42 is a gradually downward outward inclined surface. Further, the wing portion 42 has an outside surface 422 that is also a gradually downward outward inclined surface.

Please refer to FIGS. 1, 6, 7 and 8 at the same time. Each of the shelves 10 is provided at front and rear corners at two lateral sides thereof with a C-shaped clamping member 50 each. The C-shaped clamping members 50 are located on the shelf 10 with an opening thereof facing laterally outward. Two ends of each C-shaped clamping member 50 form a pair of retaining portions 51 facing toward each other, such that a space left between the two retaining portions 51 defines the opening of the C-shaped clamping member 50. Two opposite inner end surfaces 52 of an inner space enclosed in the C-shaped clamping member 50 are inclined surfaces, so that a width of the inner space of the C-shaped clamping member 50 measured between the two opposite inner end surfaces 52 gradually increases from top to bottom of the C-shaped clamping member 50. The two inclined inner end surfaces 52 of the C-shaped clamping member 50 have a gradient the same as that of the two laterally outer end surfaces 421 of the two wing portions 42. Meanwhile, an inside surface 511 of each of the two retaining portions 51 facing toward the inner space of the C-shaped clamping member 50 is an inclined surface. The inside surfaces 511 have a gradient the same as that of the two outside surfaces 422 of the two wing portions 42. The shelf 20 illustrated in FIG. 1 is provided at respective four corners with identically structured C-shaped clamping members 50.

Figure 9:
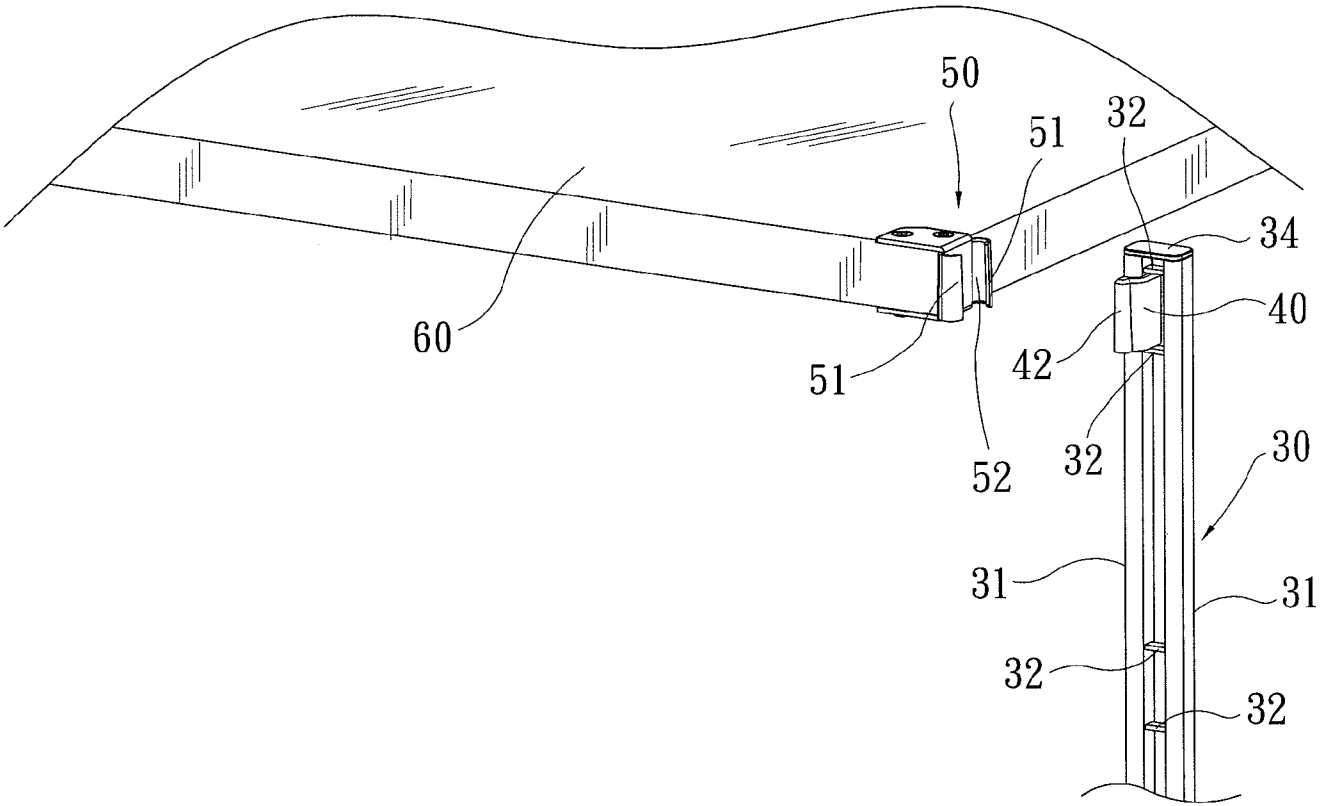
FIG. 9 is a fragmentary, exploded perspective view showing the assembling of the shelf to the vertical support according to the present invention.
Figure 10:
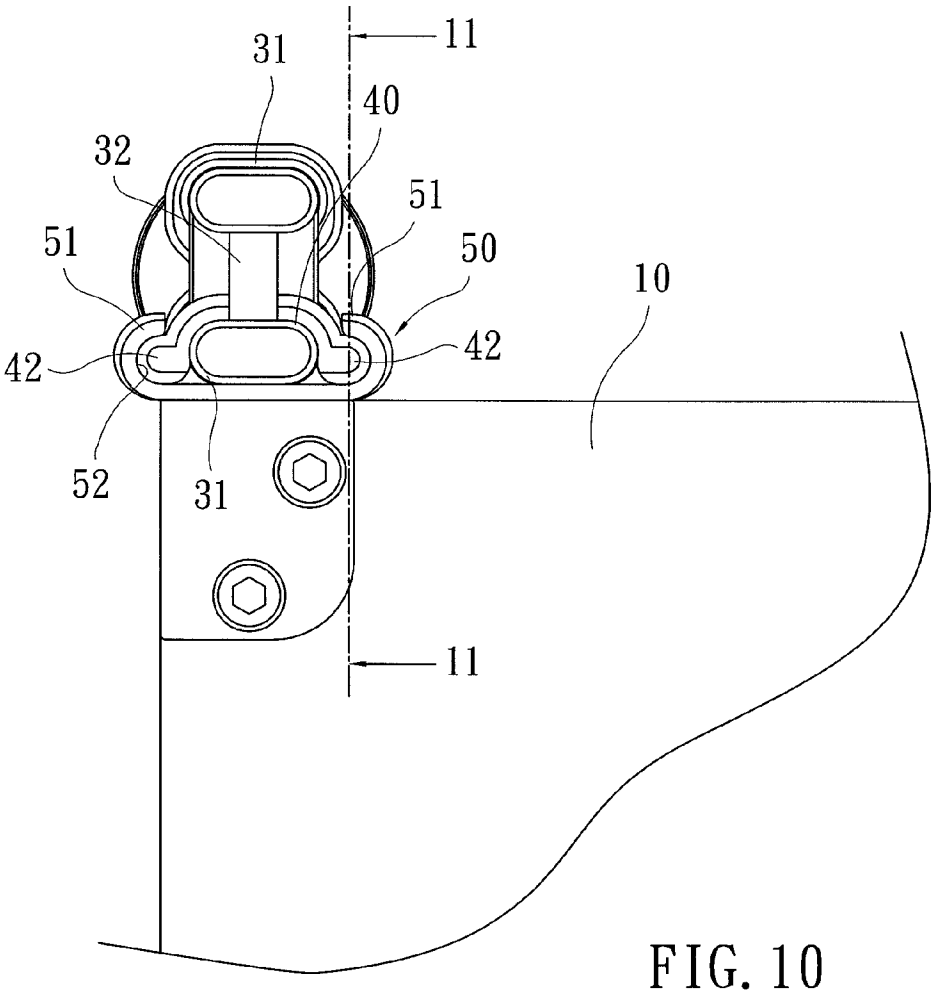
FIG. 10 is an assembled top view of FIG. 9.
Figure 11:
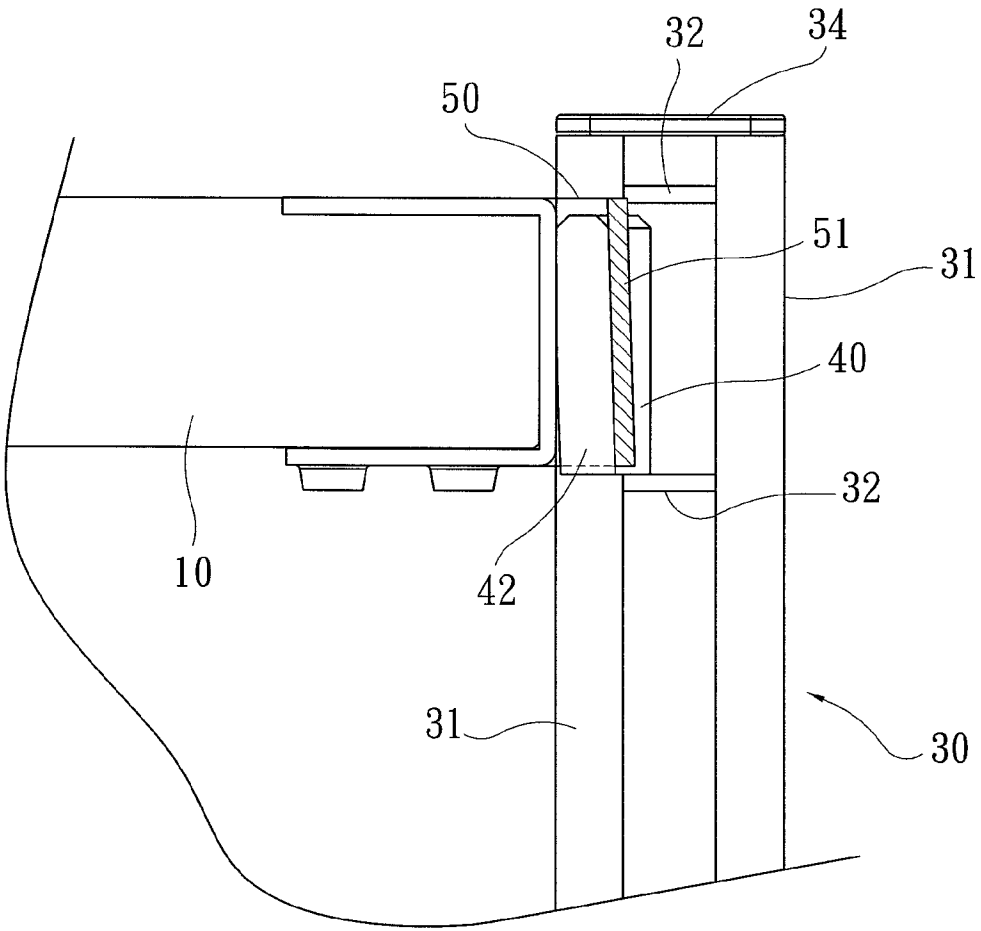
FIG. 11 is a sectional view taken along line 11-11 of FIG. 10.

Please refer to FIGS. 9, 10 and 11 at the same time. Each of the clamping members 40 assembled to the vertical support 30 is connected to the shelf 10 by guiding the two wing portions 42 of the clamping member 40 into one corresponding C-shaped clamping member 50 on the shelf 10. The width and a depth of the inner space of the C-shaped clamping member 50 at a bottom thereof are larger than a distance between the laterally outer end surfaces 421 of the two wing portions 42 and the thickness of the wing portions 42 at a top thereof, allowing the C-shaped clamping member 50 to be easily externally downward fitted around the two wing portions 42 of the clamping member 40. With the same gradient thereof, the two inclined inner end surfaces 52 of the C-shaped clamping member 50 can fitly bear on the laterally outer end surfaces 421 of the two wing portions 42 of the clamping member 40 and produce a tightening effect on the two wing portions 42. Meanwhile, with the same gradient thereof, the inclined inside surfaces 511 of the two retaining portions 51 of the C-shaped clamping member 50 can fitly bear on the outside surfaces 422 of the two wing portions 42 and push the wing portions 42 toward the shelf 10. At this point, the two wing portions 42 would be brought to move closer toward each other to thereby reduce a size of the open side of the receiving recess 41 on the clamping member 40, so that the post 31 is more tightly clamped in the receiving recess 41. Meanwhile, the C-shaped clamping member 50 produces a tightening effect on the clamping member 40 to thereby enable these two members 50, 40 to firmly connect to each other.

To assemble the shelf 10 to four vertical supports 30, first assemble the clamping members 40 to the posts 31 of the vertical supports 30. Then, externally fit each of the C-shaped clamping members 50 provided on four corners of the shelf 10 around the two wing portions 42 of a corresponding clamping member 40 from a top thereof, and push the shelf 10 downward for the C-shaped clamping members 50 to tightly connect to the clamping members 40. More specifically, the C-shaped clamping members 50 at the front and rear corners of the two lateral sides of the shelf 10 are respectively fitted around the wing portions 42 of the clamping members 40 on the four vertical supports 30 to assemble the shelf 10 to between the four vertical supports 30.

Since the clamping member 40 possesses some degree of resilience and the receiving recess 41 thereof has an inner diameter equal to an outer diameter of the post 31, the clamping member 40 can be forced against the post 31 to clamp the post 31 in the receiving recess 41. That is, the clamping member 40 can be attached to the post 31 without the risk of automatically separating therefrom. In the illustrated embodiment, the clamping member 40 is clamped to the oblong post 31 and is not rotatable relative to the post 31 to thereby facilitate easy and stable assembling of the shelf 10 to the vertical supports 30.

The connecting members 32 of the vertical supports 30 are provided in pairs. The pairs of connecting members 32 are vertically equally spaced between the left and the right post 31 to connect the two posts 31 to each other. A distance between the two connecting members 32 in the same one pair is larger than and very close to a height of the clamping member 40, so that the clamping member 40 can be located between the two connecting members 32. When it is desired to separate the shelf 10 from the clamping members 40, the clamping members 40 are stopped by the upper connecting members 32 from moving upward along with the shelf 10. Therefore, the C-shaped clamping members 50 on the shelf 10 can be easily separated from the clamping members 40 on the posts 31.

Figure 12:
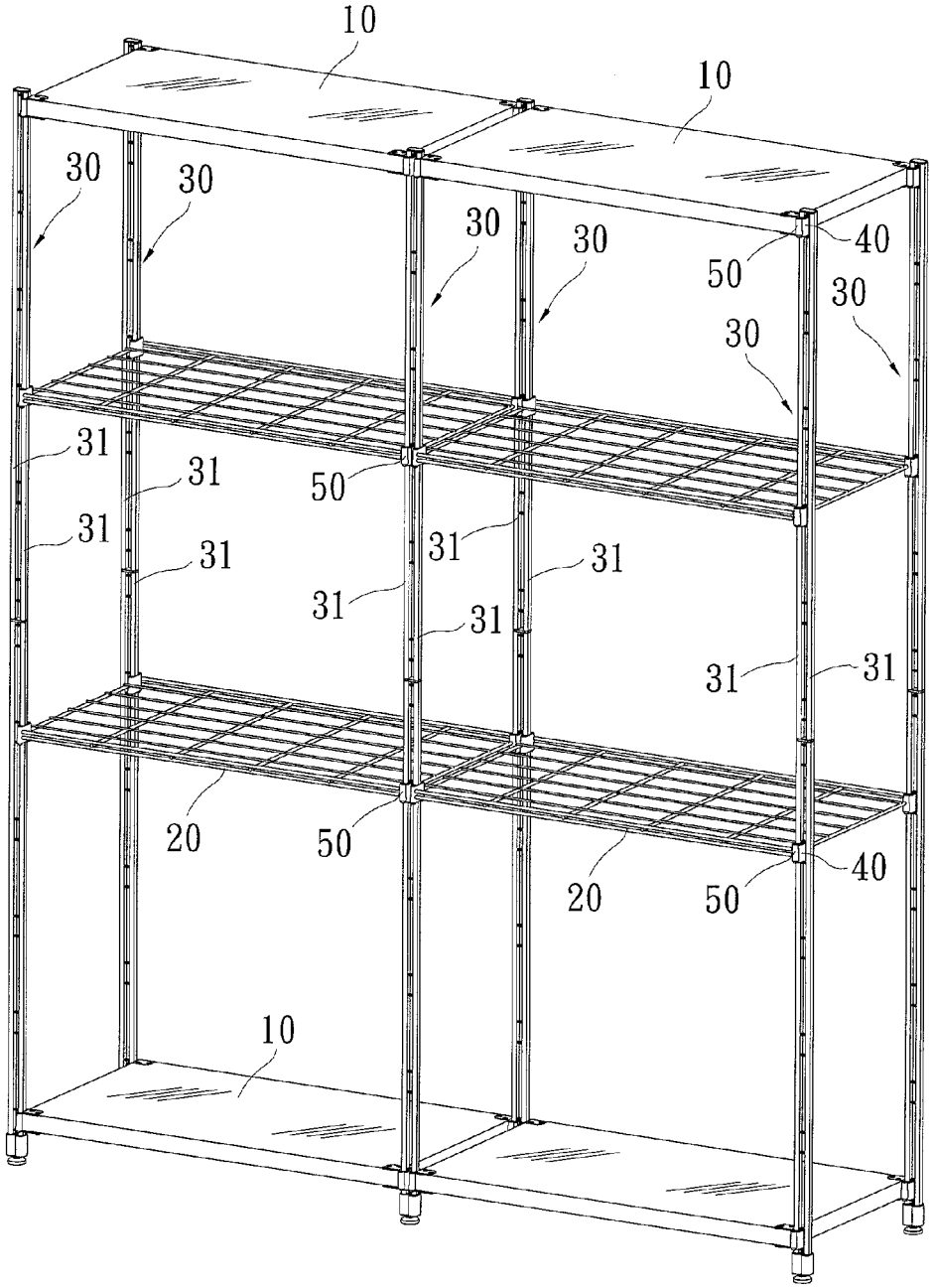
FIG. 12 shows the sectional rack of FIG. 1 is sidewardly extended by connecting more shelves and vertical supports thereto, so as to obtain a rack with an increased overall width.

Please refer to FIG. 12. The sectional rack illustrated in FIG. 1 can be sidewardly extended to provide a larger rack by assembling an additional pair of front and rear vertical supports 30 to one lateral side of the original sectional rack and assembling two or more additional shelves 10, 20 to the extended sectional rack. Wherein, different shelves 10, 20 may be assembled to the left and the right post 31 of the same one vertical support 30, and the shelves 10, 20 may be assembled to the left and the right post 31 at the same height, enabling the fully assembled rack to have a harmonious and aesthetic appearance.

In the sectional rack according to the present invention, when the C-shaped clamping members 50 on the shelves 10, 20 are fitted around the clamping members 40 on the vertical supports 30 to produce a tightening force against the clamping members 40, the clamping members 40 are brought to tightly clamp on the posts 31 of the vertical supports 30. As a result, the shelves 10, 20 are firmly connected to the vertical supports 30 via the firm engagement of the C-shaped clamping members 50 with the clamping members 40. Therefore, the fully assembled sectional rack has upgraded structural strength and is able to resist increased lateral force applied thereto without wobbling sidewardly.

What is claimed is:

1. A sectional rack, comprising:

a first discrete vertical support, comprising:

a first laterally juxtaposed post;

a second laterally juxtaposed post;

a first connecting member; and a second connecting member, wherein said first connecting member and said second connecting members are connected to and between said first laterally juxtaposed post and said second laterally juxtaposed post, such that the space between said first laterally juxtaposed post and said second laterally juxtaposed post is defined by an identical connecting-member length of said first connecting member and said second connecting member;

a second discrete vertical support;

a third discrete vertical support;

a fourth discrete vertical support;

a first clamping member, comprising:

a vertically extended receiving recess, sized for said first laterally juxtaposed post to partially surround said first laterally juxtaposed post, thereby allowing said first clamping member to assemble to said first vertical support with the open side of the vertically extended receiving recess facing away from said second laterally juxtaposed post of said first vertical support;

a first wing portion, having a width that is increased from an upper end of said first wing portion to a lower end of said first wing portion, such that an outer surface of said first wing portion is a downwardly and outwardly inclined surface; and a second wing portion;

a second clamping member; and a first shelf, comprising:

a first corner;

a second corner;

a third corner;

a fourth corner;

a first C-shaped clamp, disposed and extending laterally from said first corner, further comprising:

an opening facing laterally outward from said first shelf;

a first end;

a second end, wherein the space between said first end and said second end defines said opening of said C-shaped clamping member;

a first inner end surface;

a second opposite inner end surface, wherein said first inner end surface and said second opposite inner end surface are inclined so that a width of the inner space of said C-shaped clamp between said first inner end surface and said second opposite inner end surface gradually increases from top to bottom of said C-shaped clamp with a same gradient as the outer surface of said first wing portion and the outer surface of said second wing portion of said first clamping member, such that when said first inner end surface and said second opposite inner end surface tightly bear on the outer end surface of said first wing portion and the outer end surface of said second wing portion of said first clamping member, said first wing portion and said second wing portion are pushed toward each other, causing said first clamping members to tightly clamp on said first laterally juxtaposed post of said first discrete vertical support;

a second C-shaped clamp, disposed and extending laterally from said second corner;

a third C-shaped clamp, disposed and extending laterally from said third corner; and a fourth C-shaped clamp, disposed and extending laterally from said fourth corner.

2. The sectional rack as claimed in claim 1, wherein said first clamping member is made of a plastic material.

3. The sectional rack as claimed in claim 1, wherein said first laterally juxtaposed post comprises a pipe having an oblong cross section, further comprising two opposite round ends and a straight middle body.

4. The sectional rack as claimed in claim 1, wherein said first laterally juxtaposed post comprises a pipe having an elliptic cross section.

5. The sectional rack as claimed in claim 1, wherein the distance between said first connecting member and said second connecting member is larger than and very close to a height of said first clamping member, so that the clamping member can be positioned between said first connection member and said second connecting member.

6. The sectional rack of claim 1, further comprising:

a third clamping member;

a fourth clamping member;

a second shelf, comprising:

a fifth corner;

a sixth corner;

a fifth C-shaped clamp, disposed and extending laterally from said fifth corner; and a sixth C-shaped clamp, disposed and extending laterally from said sixth corner; and said second discrete vertical support further comprises:

a third laterally juxtaposed post; and a fourth laterally juxtaposed post;

wherein said first clamping member is disposed at a first height around said first laterally juxtaposed post and engaged with said first C-shaped clamp, said second clamping member is disposed at said first height around said third laterally juxtaposed post and engaged with said second C-shaped clamp, said third clamping member is disposed at said first height adjacent to said first clamping member around said second laterally juxtaposed post and engaged with said fifth C-shaped clamp, and said fourth clamping member is disposed at said first height adjacent to said second clamping member around said fourth laterally juxtaposed post and engaged with said sixth C-shaped clamp.

* * * * *